US011805903B2

(12) United States Patent
Lu et al.

(10) Patent No.: US 11,805,903 B2
(45) Date of Patent: Nov. 7, 2023

(54) GAP-FREE EPIDEMIC-PREVENTING PARTITION BOARD STRUCTURE

(71) Applicant: Wen's Design Inc., Keelung (TW)

(72) Inventors: Haur-Wen Lu, Keelung (TW); Althea Chen, Keelung (TW)

(73) Assignee: WEN'S DESIGN INC., Keelung (TW)

( * ) Notice: Subject to any disclaimer, the term of this patent is extended or adjusted under 35 U.S.C. 154(b) by 123 days.

(21) Appl. No.: 17/569,215

(22) Filed: Jan. 5, 2022

(65) Prior Publication Data

US 2022/0257017 A1 Aug. 18, 2022

(30) Foreign Application Priority Data

Feb. 17, 2021 (TW) ..... 110201801

(51) Int. Cl.
*B32B 3/00* (2006.01)
*A47B 97/00* (2006.01)

(52) U.S. Cl.
CPC ..... *A47B 97/00* (2013.01)

(58) Field of Classification Search
CPC ..... A47B 97/00
See application file for complete search history.

(56) References Cited

U.S. PATENT DOCUMENTS 4,981,086 A * 1/1991 Barca ..... A62B 15/00 D24/232
2022/0346551 A1* 11/2022 O'Brien ..... A47B 97/00

FOREIGN PATENT DOCUMENTS

JP 2022080067 A * 5/2022
KR 102201234 B1 * 1/2021

* cited by examiner

*Primary Examiner* — Elizabeth E Mulvaney
(74) *Attorney, Agent, or Firm* — Muncy, Geissler, Olds & Lowe

(57) ABSTRACT

Disclosed is a gap-free epidemic-preventing partition board structure, which includes a transparent board, a plurality of arc surfaces, two lateral side edges, a flat form, and a plurality of arc surface transitions. The arc surfaces are arranged on a bottom portion of the transparent board. The arc surfaces gradually change in an upward direction into the flat form. The two lateral side edges are arranged on two opposite sides of the arc surfaces and are on the same plane as the flat form. The arc surfaces include the arc surface transitions. The arc surfaces, the flat form, the two lateral side edges, and arc surface transitions that make up the gap-free epidemic-preventing partition board structure are integrally formed together as a unitary structure. The bottom in the form of multiple arc surfaces helps increase a contact area with a tabletop for securely standing thereon to achieve separation for epidemic prevention.

6 Claims, 5 Drawing Sheets

GAP-FREE EPIDEMIC-PREVENTING PARTITION BOARD STRUCTURE

FIELD OF THE INVENTION

The present invention relates to an epidemic-preventing partition board structure, and more particular to a gap-free epidemic-preventing partition board structure that increases an area of contact with a tabletop and is securely erectable on the tabletop to achieve an effect of epidemic prevention through separation, and also helps prevent interference or notch formed in successively arranging.

BACKGROUND OF THE INVENTION

A known epidemic-preventing partition board structure includes a transparent board of which a bottom is directly bonded to another transparent board to achieve an effect of erection. This results in waste of material and is hard to stow. An alternative is an arrangement of multiple bases and a transparent board is fixed on the bases. This results in various drawbacks, such as the bottom being not in a close-fitting state, being not of aesthetics, being hard to assemble, and waste of material, leading to weakened market competition power, and economically inefficient.

Thus, in view of the above deficiencies, the present invention aims to provide a solution to resolve such drawbacks.

SUMMARY OF THE INVENTION

The primary objective of the present invention is to provide a gap-free epidemic-preventing partition board structure, of which a bottom portion that is for contacting a tabletop is made in the form of a plurality of arc surfaces or curved surfaces to help increase a contact area thereof with a tabletop for securely standing on the tabletop. The arc surfaces or the curved surfaces gradually change, in an upward direction, into a flat form, and two lateral side edges are provided on two sides of the arc surfaces or the curved surfaces are arranged coplanar with the flat form. Particularly, the gap-free epidemic-preventing partition board structure, in the entirety thereof, is made by means of thermal forming or injection molding to achieve the effects of being simplified, economic, and aesthetic, and is convenient for directly positioning on a tabletop to achieve secured erection for the purpose of separation for epidemic prevention. Further, the arrangement of the arc surfaces or the curved surfaces enables stacking or overlapping made in a front-rear direction for easy stowage and reduction of storage space. And further, the two lateral side edges are on the same plane as the flat form to allow two side edges of the gap-free epidemic-preventing partition board structures to be positioned against each other to form a continuous partition on a tabletop.

Thus, to achieve the above objective, the present invention provides a gap-free epidemic-preventing partition board structure, which comprises: a transparent board, a plurality of arc surfaces, two lateral side edges, a flat form, and a plurality of arc surface transitions, wherein the arc surfaces are arranged on a bottom portion of the transparent board, and the arc surfaces gradually change in an upward direction into the flat form, and further, the two lateral side edges are arranged on two opposite sides of the arc surfaces and are on a same plane as the flat form, and the arc surfaces comprise the arc surface transitions; the arc surfaces, the flat form, the two lateral side edges, and the arc surface transitions that make up the gap-free epidemic-preventing partition board structure are integrally formed together as a unitary structure.

In the above-described gap-free epidemic-preventing partition board structure, the gap-free epidemic-preventing partition board structure is made by means of thermal forming.

In the above-described gap-free epidemic-preventing partition board structure, the gap-free epidemic-preventing partition board structure is made by means of injection molding.

Further, the present invention also provides a gap-free epidemic-preventing partition board structure, which comprises: a transparent board, a plurality of curved surfaces, two lateral side edges, a flat form, and a plurality of curved surface transitions, wherein the curved surfaces are arranged on a bottom portion of the transparent board, and the curved surfaces gradually change in an upward direction into the flat form, and further, the two lateral side edges are arranged on two opposite sides of the curved surfaces and are on a same plane as the flat form, and the curved surfaces comprise the curved surface transitions; the curved surfaces, the flat form, the two lateral side edges, and the curved surface transitions that make up the gap-free epidemic-preventing partition board structure are integrally formed together as a unitary structure.

In the above-described gap-free epidemic-preventing partition board structure, the gap-free epidemic-preventing partition board structure is made by means of thermal forming.

In the above-described gap-free epidemic-preventing partition board structure, the gap-free epidemic-preventing partition board structure is made by means of injection molding.

In summary of the above description, the present invention provides not only innovation in respect of the spatial form, but also in addition of multiple effects as described above over the prior art, and is thus in full compliance with the required novelty and inventive step of patentability as an invention. An application is filed accordingly, and granting of a patent is earnestly solicited for encouraging innovation.

DETAILED DESCRIPTION OF THE PREFERRED EMBODIMENTS

Figure 1:
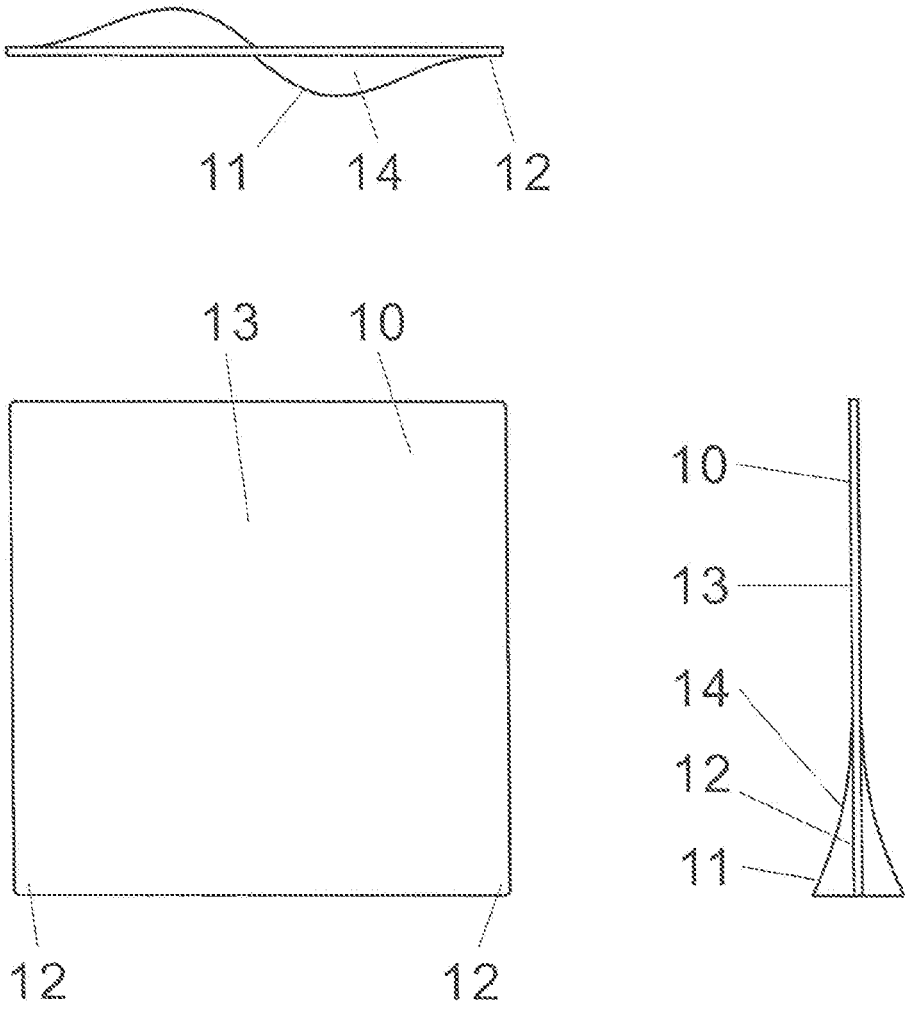
FIG. 1 shows three views of a gap-free epidemic-preventing partition board structure according to a first embodiment of the present invention.

Ways of embodying the present invention will be described below with reference to FIGS. 1-5. The description is not intended to limit the way of embodying the present invention, and illustrates only one of the embodiments of the present invention. Further, in the drawings and the embodiments, similar or like reference signs are used to refer to identical, substantially identical, or functionally identical components and parts in all of the drawings. The drawings are prepared in a simplified form, and the drawings are not drawn to precise scale for all the embodiments.

Firstly, referring to FIGS. 1-4, a gap-free epidemic-preventing partition board structure according to a first embodiment of the present invention comprises: a transparent board 10, a plurality of arc surfaces 11, two lateral side edges 12, a flat form 13, a plurality of arc surface transitions 14, wherein the arc surfaces 11 are arranged on a bottom portion of the transparent board 10 and the arc surfaces 11 gradually change, as transiting in an upward direction, into the flat form 13, and also, the two lateral side edges 12 that are arranged on two opposite sides of the arc surfaces 11 are on a same plane as the flat form 13, and the arc surfaces 11 comprise the arc surface transitions 14; the arc surfaces 11, the flat form 13, the two lateral side edges 12, and the arc surface transitions 14 that make up the gap-free epidemic-preventing partition board structure are integrally formed together as a unitary structure.

Figure 2:
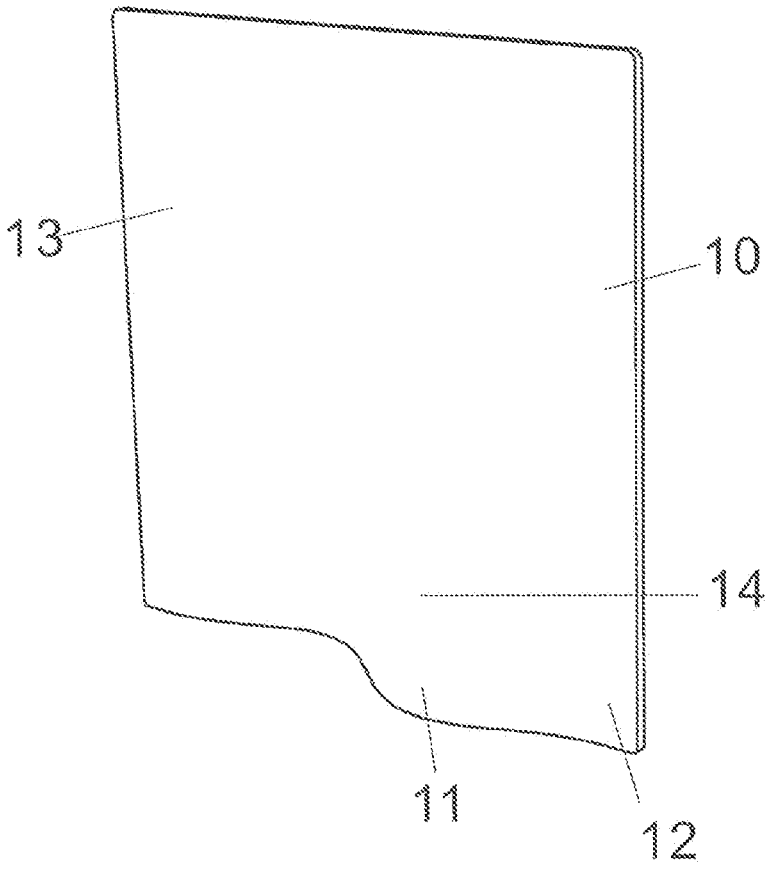
FIG. 2 shows a first perspective view of the gap-free epidemic-preventing partition board structure according to the first embodiment of the present invention.
Figure 3:
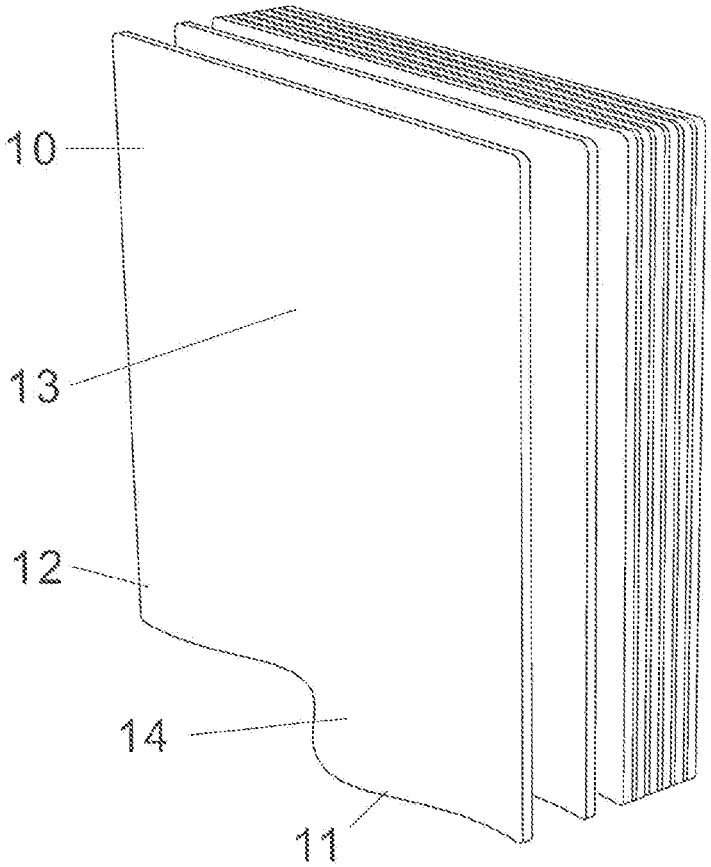
FIG. 3 shows a second perspective view of the gap-free epidemic-preventing partition board structure according to the first embodiment of the present invention.
Figure 4:
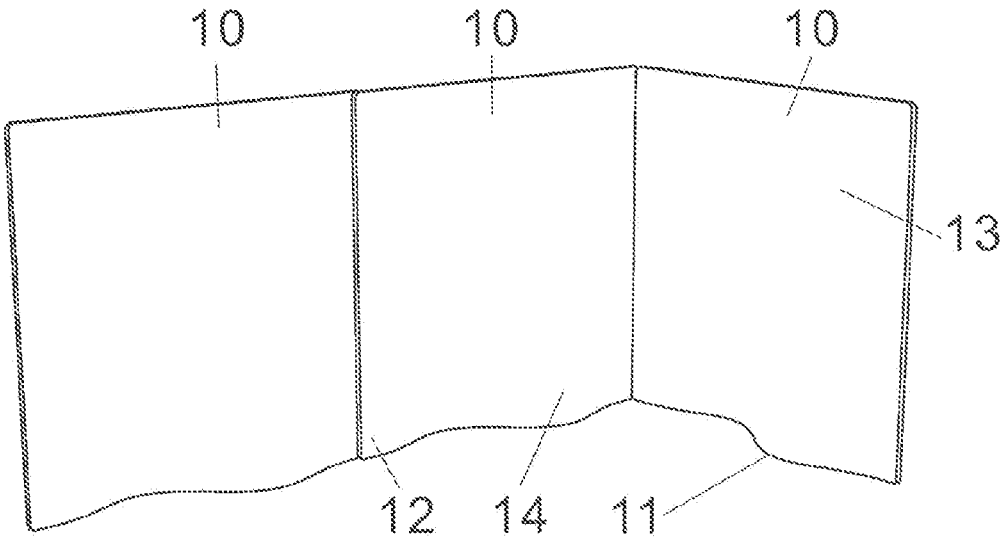
FIG. 4 shows a third perspective view of the gap-free epidemic-preventing partition board structure according to the first embodiment of the present invention.

In the structure, as shown in FIG. 2, the gap-free epidemic-preventing partition board structure of the present invention enables the transparent board 10 to be directly and individually positioned on a tabletop to achieve an effect of stable erection for the purpose of separation; or, as shown in FIG. 3, multiple ones of the transparent board 10 can be stacked on and overlapping each other for easy storage and reduction of storage space; further, as shown in FIG. 4, the left side and the right side of the transparent board 10 may be positioned against each other so as to form a continuous partition that extends in a horizontal direction, or a vertical direction, or both on a desktop.

Figure 5:
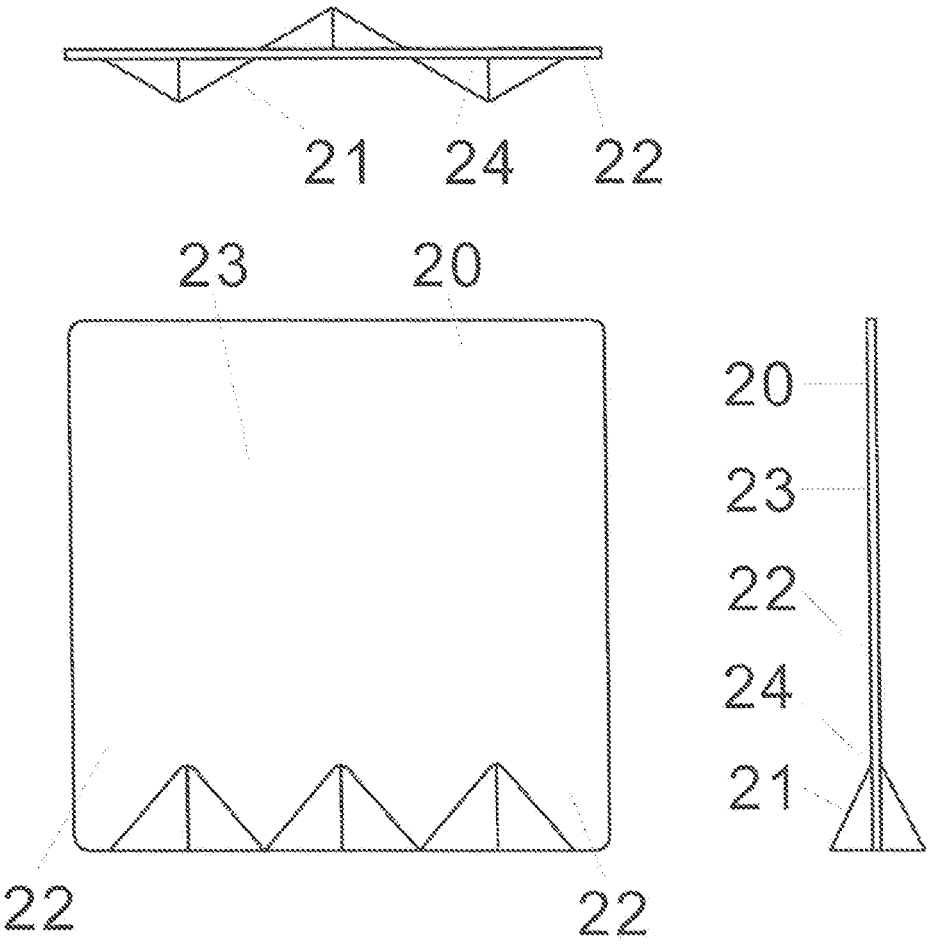
FIG. 5 shows three views of a gap-free epidemic-preventing partition board structure according to a second embodiment of the present invention.

Further, referring to FIG. 5, a gap-free epidemic-preventing partition board structure according to a second embodiment of the present invention comprises: a transparent board 20, a plurality of curved surfaces 21, two lateral side edges 22, a flat form 23, a plurality of curved surface transitions 24, wherein the curved surfaces 21 are arranged on a bottom portion of the transparent board 20, and the curved surfaces 21 gradually change, as transiting in an upward direction, into the flat form 23, and also, the two lateral side edges 22 that are arranged on two opposite sides of the curved surfaces 21 are on a same plane as the flat form 23, and the curved surfaces 21 comprise the curved surface transitions 24; the curved surfaces 21, the flat form 23, the two lateral side edges 22, and the curved surface transitions 24 that make up the gap-free epidemic-preventing partition board structure are integrally formed together as a unitary structure. Also, the scenario of using the second embodiment is similar to that shown in FIGS. 2-4.

Finally, the gap-free epidemic-preventing partition board structure of the embodiments described above can be made by means of thermal forming or injection molding.

Thus, the present invention indeed provides a gap-free epidemic-preventing partition board structure, of which a portion of the bottom thereof that is contactable with a desktop is made in the form of a plurality of arc surfaces or a curved surfaces, in order to increase a contact area thereof with the tabletop for being securely erected on the tabletop, and the arc surfaces or the curved surfaces gradually changes, as transiting in an upward direction, into a flat form, and the two lateral side edges on the two opposite sides of the arc surfaces or the curved surfaces are on the same plane as the flat form, and particularly, the gap-free epidemic-preventing partition board structure, in the entirety thereof, is formed integrally as a unit by means of thermal forming or injection molding, achieving effects of being simplified, economic, and aesthetic, and being convenient for directly positioning on a tabletop to achieve secured erection for the purpose of separation for epidemic prevention; further, the arrangement of the arc surfaces or the curved surfaces enables stacking or overlapping made in a front-rear direction for easy stowage and reduction of storage space, and further, the two lateral side edges being on the same plane as the flat form allows two side edges of the gap-free epidemic-preventing partition board structures to be positioned against each other to form a continuous partition on a tabletop.

In view of the description provided above, the improvement achieved in the present invention has not been known and publicly used and is in full compliance with the stipulated requirements for a patent. An application for a patent is filed accordingly, and early allowance of the patent is respectfully requested.

It should be noted that the above description provides only one preferred embodiment of the present invention. Alterations made according to the idea of the present invention, which generates functions and effects that do not depart from the spirit covered by the disclosure and the drawings, should be considered falling in the scope of the present invention defined by the claims.

What is claimed is:

1. A gap-free epidemic-preventing partition board structure, comprising: a transparent board, a plurality of arc surfaces, two lateral side edges, a flat form, and a plurality of arc surface transitions, wherein the arc surfaces are arranged on a bottom portion of the transparent board, and the arc surfaces gradually change in an upward direction into the flat form, and further, the two lateral side edges are arranged on two opposite sides of the arc surfaces and are on a same plane as the flat form, and the arc surfaces comprise the arc surface transitions; the arc surfaces, the flat form, the two lateral side edges, and the arc surface transitions that make up the gap-free epidemic-preventing partition board structure are integrally formed together as a unitary structure.

2. The gap-free epidemic-preventing partition board structure according to claim 1, wherein the gap-free epidemic-preventing partition board structure is made by means of thermal forming.

3. The gap-free epidemic-preventing partition board structure according to claim 1, wherein the gap-free epidemic-preventing partition board structure is made by means of injection molding.

4. A gap-free epidemic-preventing partition board structure, comprising: a transparent board, a plurality of curved surfaces, two lateral side edges, a flat form, and a plurality of curved surface transitions, wherein the curved surfaces are arranged on a bottom portion of the transparent board, and the curved surfaces gradually change in an upward direction into the flat form, and further, the two lateral side edges are arranged on two opposite sides of the curved surfaces and are on a same plane as the flat form, and the curved surfaces comprise the curved surface transitions; the curved surfaces, the flat form, the two lateral side edges, and the curved surface transitions that make up the gap-free epidemic-preventing partition board structure are integrally formed together as a unitary structure.

5. The gap-free epidemic-preventing partition board structure according to claim 4, wherein the gap-free epidemic-preventing partition board structure is made by means of thermal forming.

6. The gap-free epidemic-preventing partition board structure according to claim 4, wherein the gap-free epidemic-preventing partition board structure is made by means of injection molding.

* * * * *